US007841039B1

(12) United States Patent
Squire

(10) Patent No.: US 7,841,039 B1
(45) Date of Patent: Nov. 30, 2010

(54) CLEANING IMPLEMENT, CLEANING PAD, AND SCRUBBING DEVICE

(76) Inventor: William Squire, 96 N. Rockledge Dr., Livingston, NJ (US) 07039

( * ) Notice: Subject to any disclaimer, the term of this patent is extended or adjusted under 35 U.S.C. 154(b) by 1104 days.

(21) Appl. No.: 11/495,498

(22) Filed: Jul. 28, 2006

Related U.S. Application Data

(60) Provisional application No. 60/714,273, filed on Sep. 6, 2005.

(51) Int. Cl.
*A47L 13/12* (2006.01)
*A47L 13/20* (2006.01)
*A47L 13/256* (2006.01)

(52) U.S. Cl. ..... 15/118; 15/228; 15/229.11; 15/229.13

(58) Field of Classification Search ..... 15/114, 15/115, 118, 209.1, 223, 224, 228, 229.11–229.13
See application file for complete search history.

(56) References Cited

U.S. PATENT DOCUMENTS 3,395,415 A * 8/1968 Leland ..... 15/121
4,793,019 A * 12/1988 Stima et al. ..... 15/104.94
4,912,800 A * 4/1990 Zeltner ..... 15/114
5,591,507 A * 1/1997 Jones ..... 428/88
5,893,190 A * 4/1999 Mertz ..... 15/209.1
5,915,869 A * 6/1999 Agosto et al. ..... 401/201
5,960,508 A 10/1999 Holt et al.
6,003,191 A 12/1999 Sherry et al.
6,048,123 A 4/2000 Holt et al.
6,098,234 A * 8/2000 Jackson, Jr. ..... 15/118
6,101,661 A 8/2000 Pollicicchio et al.
D458,427 S 6/2002 Kunkler et al.
6,655,866 B1 12/2003 Morad et al.
6,766,552 B1 7/2004 Pollicicchio et al.
6,871,372 B2 3/2005 Vosbiklan et al.
2002/0065012 A1* 5/2002 Takabayashi et al. ..... 442/381
2004/0117935 A1* 6/2004 Cavalheiro ..... 15/244.1
2004/0205919 A1* 10/2004 Sims ..... 15/209.1

* cited by examiner

*Primary Examiner*—Mark Spisich
(74) *Attorney, Agent, or Firm*—William Squire

(57) ABSTRACT

A conventional floor cleaning mop has a cleaning pad support platen defining a support cleaning surface region that is arranged to releasably receive and secure a conventional cleaning pad via Velcro hook fasteners on the platen. The cleaning pad has a relatively non-abrasive cleaning surface. A scrub device with a relatively more abrasive surface is releasably or permanently attached to the pad cleaning surface by an attachment device. One or more such scrub devices may be attached to the same pad cleaning surface to cover part or all of the pad cleaning surface. The abrasive scrub devices may have different dimensions to cover different areas of the cleaning pad non-abrasive surface to provide enhanced scrubbing action as desired. The abrasive scrub devices may be provided with different abrasion surfaces having different abrasive values and may be removed to expose the full non-abrasive cleaning surface for non-abrasive cleaning. The mop may have an optional cleaning fluid dispensing spray device. Different embodiments including hand held devices are disclosed with multiple layer scrubbing pads releasably attached to each other and for attaching to a rigid hand held handle are disclosed.

15 Claims, 9 Drawing Sheets

CLEANING IMPLEMENT, CLEANING PAD, AND SCRUBBING DEVICE

This application claims the benefit of provisional application Ser. No. 60/714,273 filed Sep. 6, 2005 incorporated by reference herein in its entirety.

This application relates to cleaning devices, hand held or mops, which use cleaning pads, whether or not disposable, for example, floor cleaning pads with scrubbing devices, hand cleaning implements and more particularly, to replaceable scrubbing devices for use with conventional cleaning non-abrasive pads and associated floor mops.

U.S. Pat. No. 6,048,123 and Design Pat. No. D 458,427 disclose floor mops which employ disposable pads of the type disclosed in U.S. Pat. Nos. 6,101,661, 6,766,552 and 6,655,866 among others. Also see U.S. Pat. Nos. 6,003,191, 5,960,508. These pads are disclosed as having multiple cleaning surfaces. The prior art mop is disclosed in FIGS. 1 and 1*a* herein. All of these patents are incorporated by reference herein in their entirety.

Mop 2, FIGS. 1 and 1*a* herein, is shown generally in D 458,427 and U.S. Pat. No. 6,003,191 and a similar mop is shown in U.S. Pat. No. 6,871,372 among others of the above noted patents. Mop 2 has a shaft 6 at one end of which are handles 4 and 4' and at the other end is a universal swivel joint 8. A receptacle 10 is secured to the shaft 6 above the joint 8. Receptacle 10 includes a pump (not shown) for pumping cleaning fluid out of a nozzle 12 from a reservoir supplied by container 16, which nozzle dispenses the fluid in a spray 14 onto the floor (not shown) in front of the nozzle. The cleaning fluid is supplied from inverted fluid container 16 that rests within the receptacle 10 and includes a device for opening the normally closed mouth of the container when inserted into the receptacle. The receptacle 10 also includes a battery compartment and battery (not shown) for powering the pump. The pump is actuated by a switch 18 in the handle 4.

A prior art cleaning pad platen support 20, FIGS. 1, 1*a* and 2, which is a generally flat rectangular shaped member having a generally planar bottom surface 22, is attached to the joint 8. The bottom surface 22 defines a general cleaning region and has three elongated but rectangular arrays 24, 26, and 28 of fibrous hooks (not shown) as used in a Velcro® fastener system. Arrays 26 and 28 are generally mirror images of each other and the same dimensions while array 24 is longer and extends from end edge to end edge of the support 20. The arrays 26 and 28 of hooks are aligned with each other and spaced apart from and parallel to array 24. The hooks engage arrays 24, 26 and 28 of fibrous loops attached to a mating surface of a cleaning pad 30, FIG. 3. These arrays releasably attach cleaning pad 30, FIG. 2, to the support 20. Nozzle 12 is mounted on the support 20 and is connected to the pump via a flexible conduit 24.

In FIG. 3, the conventional prior art cleaning pad 30 associated with the mop 2 is described in several of the aforementioned patents and reference is made thereto for a detailed description of their construction and materials incorporated by reference herein. Briefly the pad 30 comprises absorbing and abrasive layers integrated into a single pad layered laminated cleaning assembly 32. The assembly 32 is rectangular and has two strips 34, 36 of fibrous material on an attachment portion of assembly 32. The strips 34, 36 mate with the hook fastener arrays 24, 26 and 28 on the support 20 to releasably attach the pad 30 to the support 20.

The pad 30 includes two opposite cleaning members 38, 40 which are flexible fibrous cloth, woven or similar elements. Members 38 and 40 are relatively thin and are attached at their elongated edges to the mating elongated edges of the central cleaning assembly and may be one piece with the scrubbing layer portion of the pad 30. The pad 30 has a cleaning assembly 32 which has an outer scrubbing layer 42. Layer 42 has a generally somewhat smooth outer surface that is used for a major portion of the cleaning task of absorbing the sprayed cleaning fluid into the pad interior layer and removing dirt and grime from a surface being cleaned.

The members 38 and 40 resemble flaps and generally attract loose debris as compared to the dirt and grime attracted to the relatively non-abrasive scrubbing layer 42 wet surface provided by the cleaning fluid. As described in U.S. Pat. No. 6,003,191, FIG. 2 thereof, one type of pad has a scrubbing layer, an attachment layer and an intermediate absorbing layer. FIG. 7 of this patent depicts a cleaning pad having an optional scrim layer between the scrubbing layer and the absorbing layer. The scrim layer is an open mesh structure of a printed resin or other synthetic material used to enhance scrubbing action of the outer scrubbing layer.

The so called scrubbing layer, however in practice, is the surface that contacts the floor surface being cleaned, the scrim layer being interior the pad.

A commercial version of a pad presently being marketed for use with the mop 2 appears as pad 30, FIG. 3. This is marketed under the brand name Swiffer® available from Proctor and Gamble. A similar product is available under the brand name Pledge Grab It® from S.C. Johnson. The present inventor does not know the particulars of the construction of the Swiffer pad. However, in use, this pad is satisfactory for removing loose dirt from a surface to be cleaned, but is not entirely satisfactory for removing ground in soil or adhesively attached soil or otherwise stuck to the surface to be cleaned. This especially true of matter that is stuck to a surface for long periods of time and hardens as if glued to that surface.

The so called scrubbing layer 38, which engages a floor or other surface to be cleaned, appears to be a woven cloth material of tight weave and relatively soft and non-abrasive in texture resembling cotton or the like material. The layer 38 does not perform satisfactory mechanical abrasive scrubbing of stubborn soil embedded or stuck to common floor surfaces such as linoleum, tiles, ceramics and the like. The present inventor has experienced difficulty in removal of such foreign matter that is stubbornly adhered to a floor surface as compared to loose particles and the like with the present prior art pad 30, FIG. 3.

The so called scrubbing layer 42 appears on the commercially available product as a relatively non-abrasive cleaning surface with little mechanical abrasive scrubbing action provided. The majority of the cleaning appears to being performed by the liquid cleaning fluid which is of insufficient strength to remove many substances stubbornly adhered to a surface such as a ceramic, tile or linoleum floor surfaces, especially that which may be embedded in minute cavities of a surface.

A need is seen by the present inventor for a solution to this problem. In U.S. Pat. No. 6,871,372, a solution to a similar problem with a different cleaning mop and head is disclosed. Here an abrasive scrubber head is rotatably permanently attached to the pad support platen. However, such a scrubber head is subject to continuous use for the life of the mop and is subject to wear. In addition, in this mop there is no pump or spray mechanism wherein the pad used may be provided prewetted with a cleaning solvent. Such a scrubber head is not made available with the mop of FIG. 1 and may be more difficult to implement due to the presence of the spray head. The scrubber head is rotated from the front of the mop so that when in use as the mop is pushed forward the head is forced into its rotated position. In the spray head embodiment of FIG. 1, the spray nozzle blocks the use of such an abrasive rotating head.

There are commercially available numerous scrubbing and cleaning devices which for the majority are hand held, many of which include relatively abrasive or non-abrasive surfaces. For example, scrubbing devices are available under the trademark Scotch Brite® available from 3 M corporation. One such device includes a relatively abrasive hand held pad of what appears to be fibrous abrasive sheet material. This appears to be a fibrous synthetic material such as a plastic. Other scrubbing pads are available from 3 M under the brand name O-Cello®. One such pad comprises an outer open fibrous plastic mesh surrounding an inner core of a soft sponge which appears to be plastic. The plastic mesh provides a somewhat more coarse abrasive scrubbing surface than the plain sponge material used in the core. This pad is marketed as a discrete pad that is about 16 mm thick. It is available as an independent pad not attachable to any other structure.

A cleaning pad marketed by 3 M corporation under the brand name Scotch Brite Dobbie® appears identical to the O-Cello pad. A further cleaning pad similar to this pad is one available under the Brillo® brand. Another product that is a discrete hand held pad is marketed under the brand name Spontex® available from Spontex, Inc. This too is a discrete hand held pad having a soft plastic sponge to which is attached a relatively more abrasive open mesh plastic knit sheet material which appears similar to the Scotch Brite pad discussed above. Similar pads are available from supermarkets under their own brand names and under numerous other brand names, such as Quickie® brand wherein a common hand held pad comprises a sponge to which an abrasive pad is adhered.

A further cleaning pad is available under the brand name Chore Boy® under the brand name Golden Fleece for a scouring cloth that is a specially treated terry cloth that is relatively abrasive.

In addition, certain cleaning pads are available as replaceable refills to a permanent handle. For example, Casabella® brand tub and tile refill scrubbers are available with an abrasive scrubbing pad attached to a sponge to which is attached a mechanical plastic molded connection having a relatively large platen to which the sponge is bonded. The connection enables the refill pad to be attached to a handle for use therewith. Other hand held implements have relative abrasive pads such as the Scotch Brite noted above attached permanently to a wooden handle. These tend to be more costly than the plain pads without the handle. Hand held pot and pan brushes are also available with bristles permanently attached to a wooden or plastic molded handle.

In addition, steel wool pads available with or without soap fillers, are available has hand held devices without handles. Stainless steel and copper scrubbing pads comprise an elongated coiled metal foil that is rolled upon itself in numerous wraps to form a hand held pad that is not attached to a handle or support. Similar pads comprise copper metal knit meshes of small gauge that is wrapped into a ball to form a pad.

The present application is directed to a recognition of such problems with present mops and to the problem that scrubbers attached to handles are either permanent or require costly plastic molded connections or have no handles and thus the abrasive pads must come in contact with a persons more delicate skin. The present application is directed to providing a solution thereto.

A surface cleaning adapter according to an embodiment of the present invention is for attachment to a support defining a relatively non-abrasive surface cleaning region, the adapter comprising a foreign matter scrubbing device having a relatively rough abrasive surface compared to the relatively non-abrasive cleaning surface of said support for loosening foreign matter on a surface to be cleaned and for overlying at least a portion of the region; and an attachment arrangement for releasably attaching the scrubbing device to the support surface at said region.

In a further embodiment, the scrubbing device abrasive surface is formed by any one of abrasive particles, a mesh material, an array of hook elements, bristles, a fibrous material or by a coiled abrasive material.

In a further embodiment, the scrubbing device comprises a substrate to which an abrasive material is attached.

In a further embodiment, the scrubbing device overlies a at least a portion of the support surface.

In a further embodiment, the attachment arrangement includes a releasable adhesive.

In an alternative embodiment, the attachment member includes an array of hook or loop elements for attachment to a complementary array of interlocking hook or loop elements on the support surface.

A cleaning device according to a further embodiment comprises a pad forming a first relatively non-abrasive cleaning surface within a cleaning region. The cleaning device also includes a foreign element scrubbing device having a second relatively rough abrasive cleaning surface as compared to the pad first cleaning surface for loosening foreign elements from a surface to be cleaned; and a first attachment element for securing the scrubbing device to the pad at the cleaning region.

In a further embodiment, the scrubbing device second abrasive cleaning surface and the pad first cleaning surface are dimensioned to cooperate to clean a given surface in the same and/or subsequent cleaning strokes of the pad.

A cleaning device according to a further embodiment comprises a support; a pad having a relatively non-abrasive first cleaning surface within a cleaning region and arranged to be secured to the support; a scrubbing element having a second relatively rough abrasive cleaning surface as compared to the first cleaning surface for loosening foreign elements from a surface to be cleaned; and an attachment device for securing the scrubbing device to the pad at the cleaning region.

A hand held cleaning device according to a further embodiment of the present invention comprises a relatively rigid handle having a platen surface attached to and adjacent to the handle. A first attachment device is attached to the platen surface. At least one scrubbing pad with a second attachment device is for attachment to the first attachment device.

An abrasive cleaning device according to a further embodiment is for use with a support having a relatively non abrasive substantially flat surface over a cleaning region defined by the support which is attached to a handle, the device comprising a relatively abrasive cleaning material compared to the support surface and forming a cleaning pad; and an attachment member for releasably attaching the abrasive cleaning material to and in abutting substantially coplanar juxtaposed relationship to the support surface.

IN THE DRAWING

FIG. 1 is an isometric exploded view of a prior art mop with no cleaning pad attached;

FIG. 1*a* is a side elevation view of the mop of FIG. 1 with a prior art cleaning pad attached;

FIG. 2 is a bottom plan view of the cleaning pad support platen of the mop of FIG. 1*a* showing Velcrow® hook arrays;

FIGS. 3 and 3*a* are isometric views of the prior art cleaning pad and attachment surface of the cleaning pad of FIG. 1*a* for attaching the pad to the support platen of FIG. 2;

FIG. 4 is an isometric exploded view of the cleaning pad of FIG. 3 with a juxtaposed abrasive scrubbing device for attachment to the pad according to an embodiment of the present invention;

FIGS. 4*a*, 4*b* and 4*c* are end views of alternative embodiments of an abrasive scrubbing device for use with a cleaning pad of the type depicted in FIG. 3;

FIG. 5 is a plan top view of the pad and abrasive scrubbing device of FIG. 4 assembled;

FIG. 5*a* is an isometric view of a portion of an abrasive scrubbing device coil material prior to coiling into an abrasive configuration;

Figure 1:
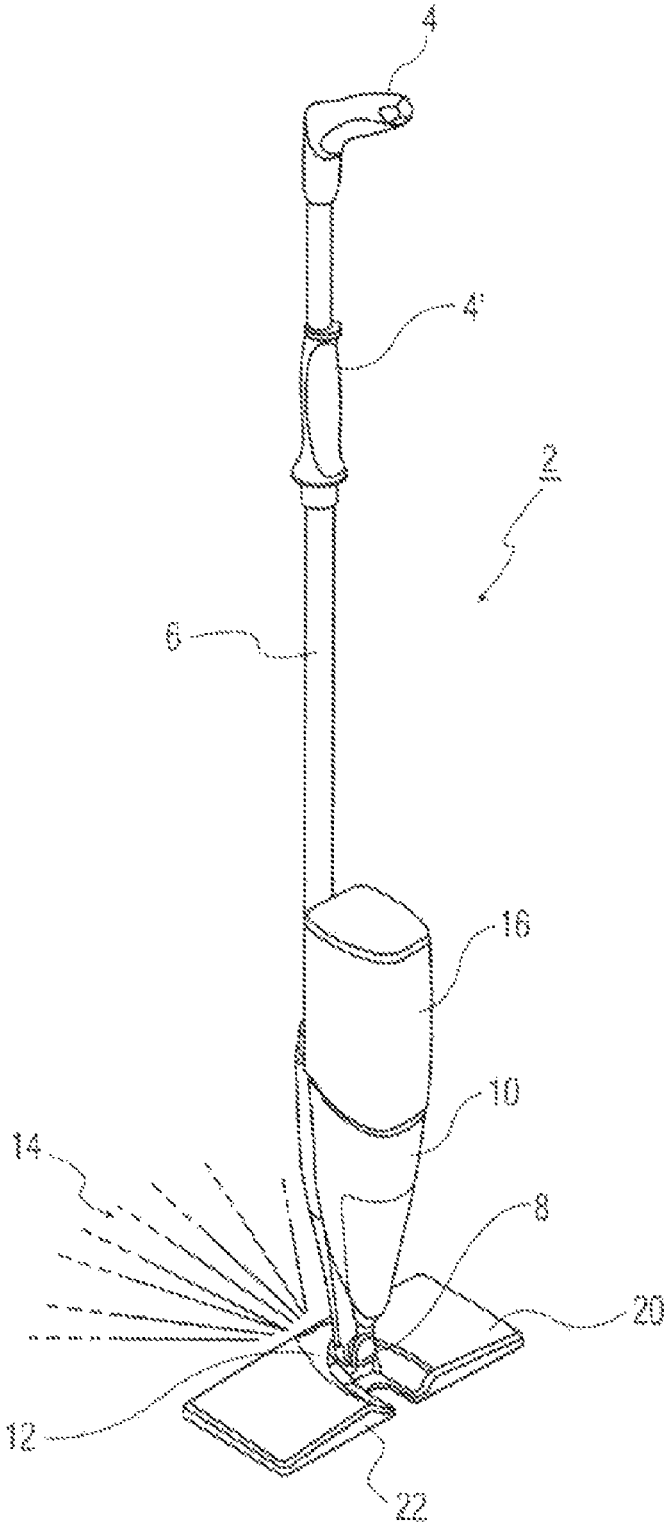
FIG. 1 PRIOR ART
Figure 1A:
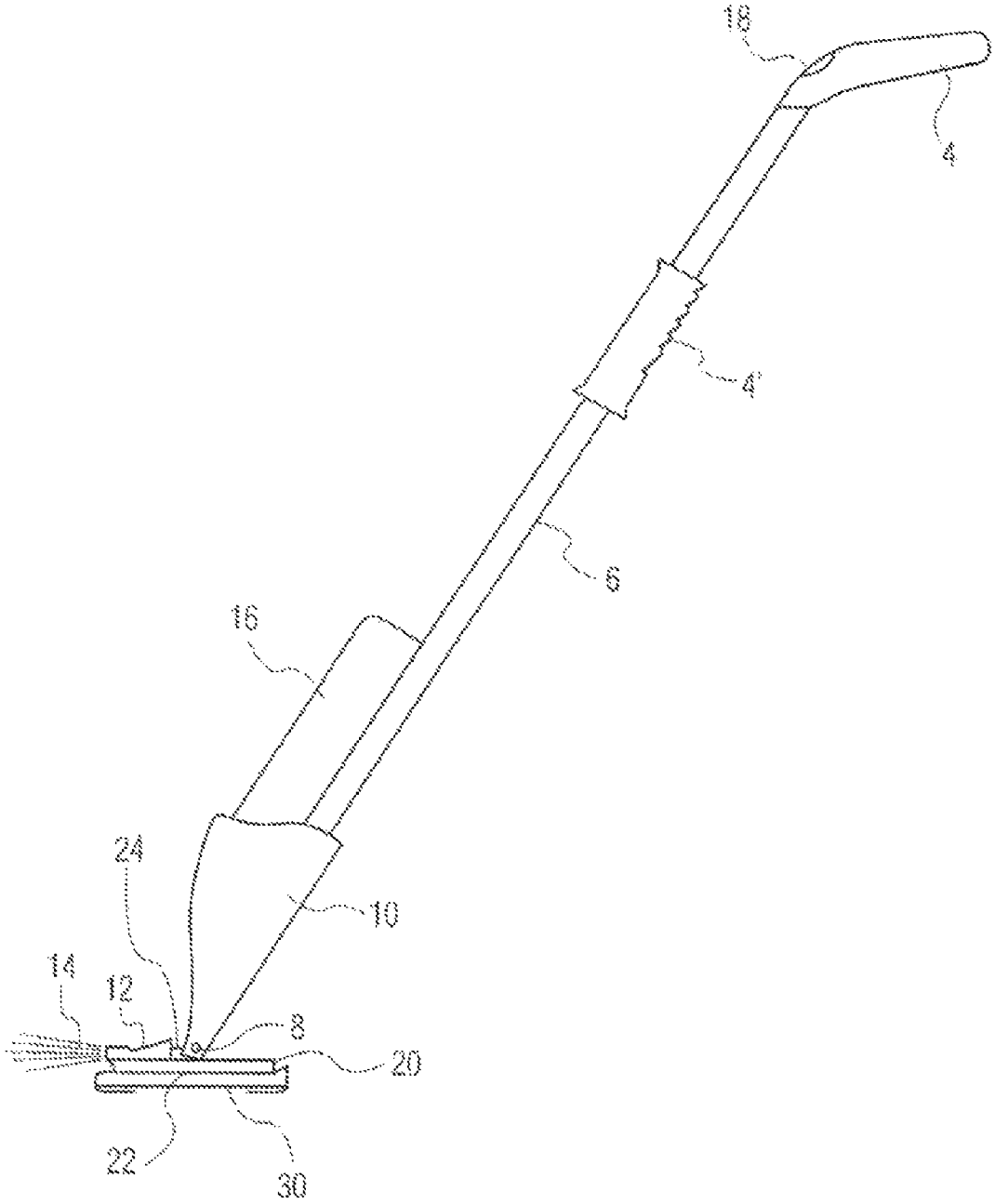
FIG. 1a PRIOR ART
Figure 2:
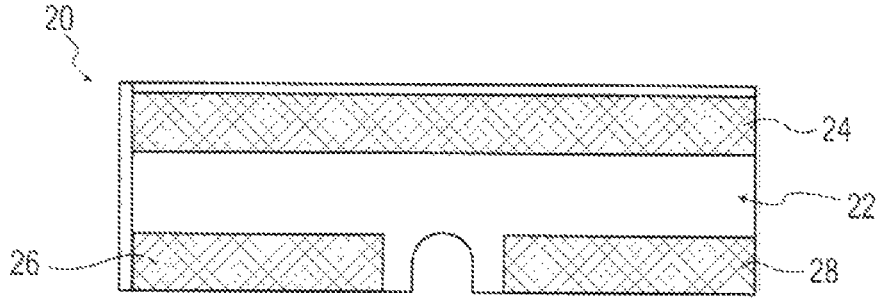
FIG. 2 PRIOR ART
Figure 3:
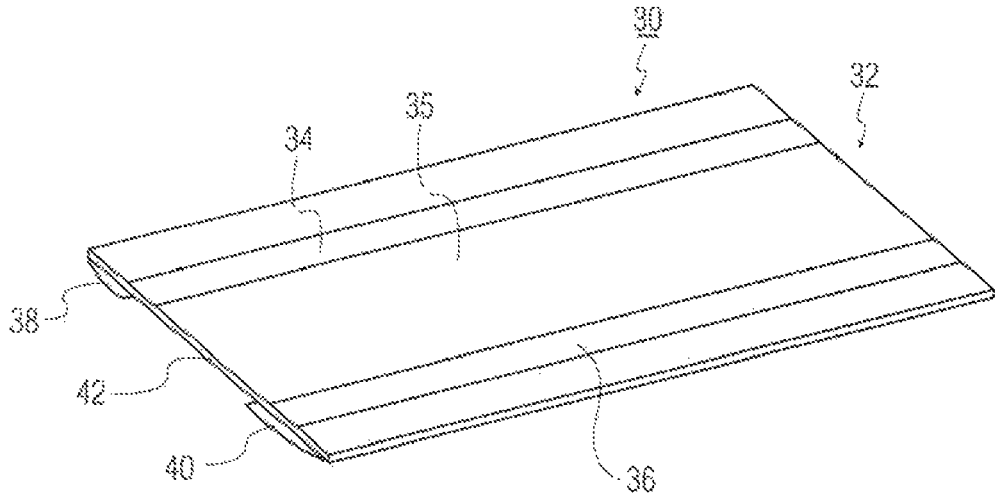
FIG. 3 PRIOR ART
Figure 3A:
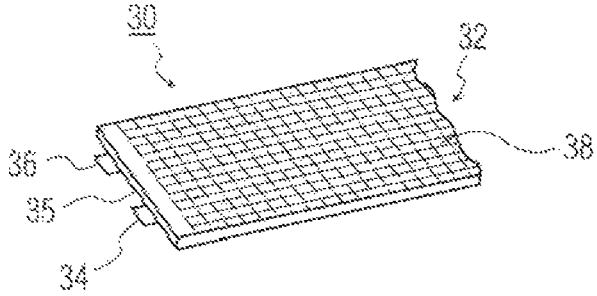
Figure 4:
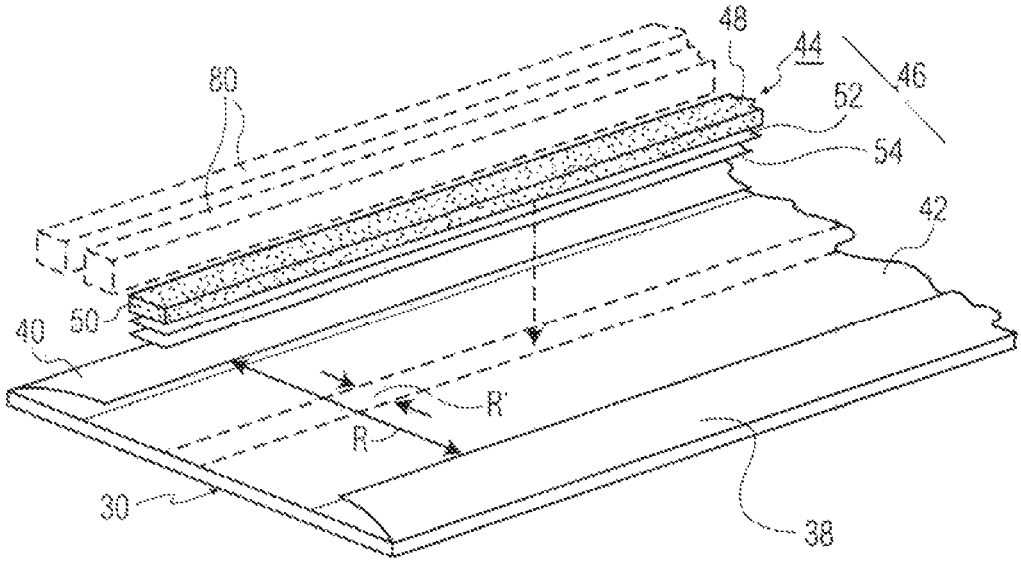

In FIG. 4, an adapter scrubbing device 44 with an abrasive scrubbing surface 48 according to an embodiment of the present invention is shown juxtaposed with a prior art pad 30 to which it is to be attached forming a pad assembly 46. The pad assembly 46 with the scrubbing device 44 is attached to the support 20 (which sometimes may be referred to as a platen) of the mop 2, FIG. 1, using the Velcro® hook and loop mechanism described above in connection with FIGS. 2 and 3. The pad 30 has the relatively non-abrasive scrubbing surface 42 as also described in the introductory portion. The device 44 comprises an abrasive element 50 forming the abrasive surface 48 and an attachment member 52.

In this embodiment, the attachment member 52 may be a retrofit element for use with present commercially available pads 30 or may be permanently factory installed on the pad 30 to form a new factory installed commercially available pad assembly 46. The attachment member 52 in one embodiment is a strip of adhesive material which is protected by a glossy paper layer 54. The adhesive material may be a glue or the like attached to each side of a film or sheet material substrate. One side of the adhesive film is permanently bonded to the abrasive element 50 and the other side is protected by paper layer 54. The attachment member may be similar to that widely commercially available such as used on labels, postage stamps, mailing envelopes and packaging and numerous other devices such as Velcro® hook and loop strips and so on, for example, but is double sided as compared to single sided adhesives in these latter materials. The adhesive material is commercially available and is of a type that readily permanently or releasably secures the adapter abrasive scrubbing device 44 to the pad scrub surface 42. By way of example, Velcro® fasteners are available with an industrial strength adhesive. Such an adhesive is used with one embodiment of the present invention.

Figure 4A:
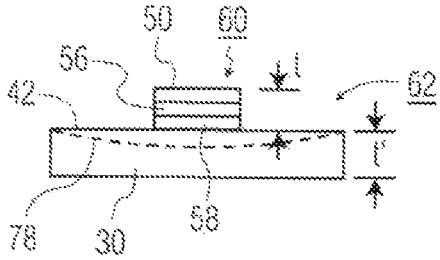

In the alternative, the abrasive element 50 of scrubbing device 60, FIG. 4*a*, may be attached to the pad surface 42 by a Velcro® assembly comprising hook member 56 and loop member 58. The scrubbing abrasive element 50 and Velcro® assembly may be supplied as a kit wherein one of the hook and loop members 56, 58 of the Velcro® assembly is attached to the element 50 and the other of the hook and loop members 56, 58 is attached to the pad 30 by a user. Such Velcro® hook and loop members with attached adhesive layers are commercially available. In the alternative, such hook and loop members may be attached at the factory so that the scrubbing device 60 is fully assembled to the pad 30 forming assembly 62, FIG. 4*a*.

The abrasive element 50 may be abrasive synthetic plastic or other material, either in sheet form or as an outer casing of a pad which is filled with soft foam or equivalent material, randomly coiled metal or plastic strips which have edges that form an abrasive surface as in presently available abrasive cleaning pads, fibrous material such as steel or plastic wool or other metal or synthetic fibrous materials or abrasive known grit particles attached to sheet material as abrasive sheets as may be used polishing and sanding applications. Some of these materials are described in the introductory portion. Also the abrasive material may be the hook portion of a Velcro® fastener which forms a relatively soft scrubbing surface.

Figure 4B:
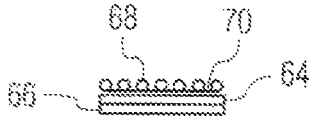

Also conventional wires used in brushes as used for cleaning grills may be used as an abrasive material or bristles in conventional brushes may be attached to Velcro fasteners to form an abrasive surface. In FIG. 4*b*, for example, a substrate strip 64 has an adhesive layer 66 on one side and an abrasive surface 68 on the other opposite side formed by abrasive wires, Velcro® hooks, bristles or grit particles 70 attached to the substrate strip 64. Of course the degree of abrasion afforded by the abrasive device is determined by the surface it is to be used on.

Generally, household flooring is more sensitive to abrasion and thus mild abrasion materials such as formed of plastics and the like as commercially available for use on present household mop sponge devices are used for such surfaces. Harder more durable surfaces such as ceramic tiles, concrete or slate can withstand more abrasion and thus greater abrasive devices may be used for such surfaces such as the Scotch Brite brand pads discussed in the introductory portion. Also the pads discussed in the introductory portion available under the brand names Brillo, Dobie and O-Cello using a knit outer mesh over an inner sponge may be used. However, the thicknesses of such pads is made thinner in the present embodiment than those presently available under those names so as to cooperate, in one embodiment, with the cleaning pad to which it is to be attached. For example such pads may be about 3-10 mm thick in one embodiment. In other embodiments, the pads may be relatively thick and cover the entire bottom surface of the platen to which they are to be attached.

Figure 4C:
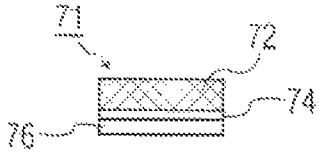

In FIG. 4*c*, an abrasive scrubbing device 71 includes a mass 72 of interlocked coiled strips of either metal or plastic or other hard abrasive material attached to a substrate film or strip 74 such as described in the introductory portion and which has an adhesive layer 76 for attaching the device 71 to the pad 30. The device 71 may be factory or user attached to the pad 30.

In FIG. 4*a,* the phantom line 78 manifests the surface 42 when compressed by device 60 abutting a surface being cleaned when in use. The surface of the abrasive element 50 is raised slightly above the scrubbing surface 42 of the pad in this embodiment. The thickness t of the device 60 is preferably less than the thickness t' of the pad 30 to maximize the amount of scrub surface of the pad 30 that engages the surface to be cleaned. This permits the pad 30 to cooperate with the scrubbing surface 42 to thoroughly clean stubborn matter in this embodiment. The thickness t preferably is about 5% to about 75% of the thickness t' to maximize such available scrub surface 42 that can engage the surface to be cleaned.

In FIG. 4, a region R is defined between the members 38 and 40 in which the abrasive scrub device 44 can be placed on the scrub surface 42 of the pad 30. The device 44, FIG. 5, has a width w. The pad 30 has a width w'. However, the cleaning members 38 and 40 occupy a portion of the width w' leaving an available exposed scrub surface 42 width w". The scrub device 44 is releasably attached in the region defined by width w" since in practice a portion of surface 42 is covered by members 38 and 40 as presently supplied commercially. This results in the approximate region R, FIG. 4, available for attachment of the scrub device 44. The region R' occupied by the scrub device is significantly less than region R dimension in this embodiment to allow a large proportion of the scrubbing surface 42 to be available for cleaning a surface. In an alternative embodiment, the scrub device may occupy the entire or major portion of the surface defined by width w" and region R between the members 38 and 40.

However, as shown by the phantom scrub devices 80 in FIG. 4, any number of scrub devices 44 that will fit in region R may be attached to the scrubbing surface 42 of the pad 30 to provide enhanced scrubbing action. In this case, most if not all of the scrub devices 44 are releasably attached so that the full scrubbing surface 42 is also available after the scrub devices are utilized initially. Thus it is preferable that the abrasive scrub devices 44 be releasably attached to the scrubbing surface 42 of the pad 30. In the alternative the scrub devices may be directly attached to the platen to which the pad 30 is attached in the alternative to using the pad 30. In effect, the entire surface 42 may be covered by one or more abrasive scrub devices 44 for an initial vigorous scrubbing of a surface to be cleaned. Then, one or more or all of the abrasive scrub devices may be removed to provide final liquid absorbing cleansing of the surface to be cleaned with a cleaning pad such as pad 30. The abrasive devices thus may cover the entire region of the pad 30 or any portion. Also the abrasive device may be attached to any section of the pad surface 30, or in the alternative, to the surface to which the pad 30 is attached, to provide access to corners and edges of surfaces adjacent to walls and other perpendicular obstructions next to the surface to be cleaned.

Figure 6:
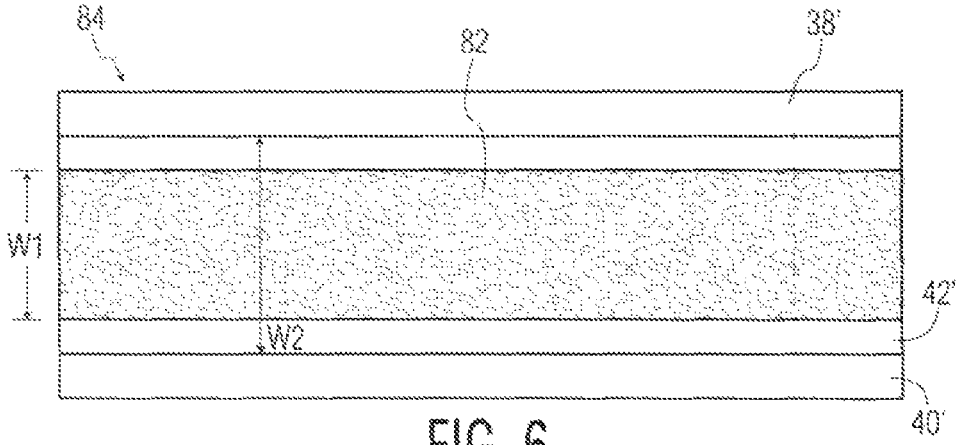
FIG. 6 is a top plan view of a cleaning pad and attached abrasive scrubbing device according to a further embodiment of the present invention.

In a further alternative embodiment, the abrasive scrub devices 44, 60 and so on may be provided in various different widths w relative to the width w" of the scrubbing surface 42 available for cleaning. In FIG. 6, for example, abrasive scrubbing device 82 is attached to scrubbing surface 42' of pad 84 between cleaning members 38' and 40' which may be identical to members 38 and 40. Here, device 82 has a width w1 that is about 50% of the width w2 of the available scrubbing surface 42'. Other abrasive scrub devices of other relative widths to the width w2 and of different abrasion values may be provided in kit form to the user for example for use on surfaces having different degrees of difficulty to remove foreign matter. The abrasive scrub devices then can be removed, cleaned if necessary for reuse if desired, and for final cleaning as provided by the present commercially available cleaning pad 30. The abrasive scrub devices can be used with the same cleaning fluid that is presently employed in the prior art or in the alternative, a stronger cleaning solvent may be used in conjunction with the abrasive devices on tiles, ceramic or concrete floors or surfaces.

Figure 8:
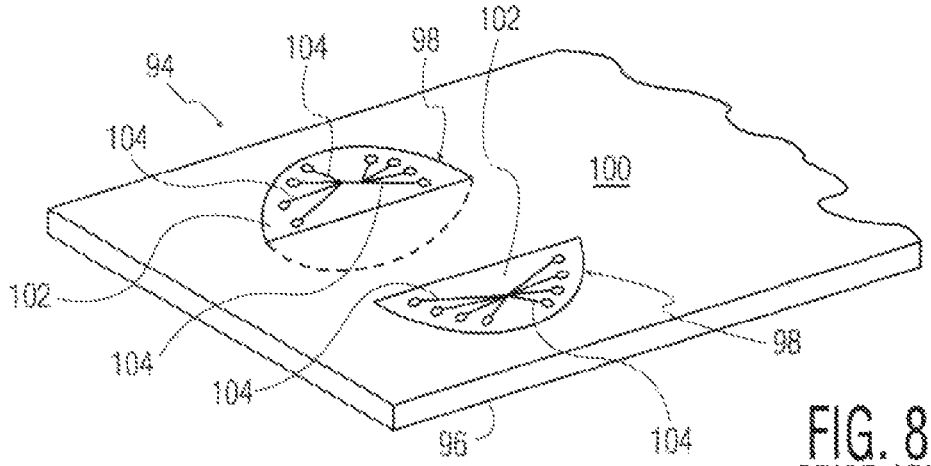
FIG. 8 PRIOR ART
FIG. 8 is an isometric view of a prior art support platen according to a further embodiment.
Figure 9:
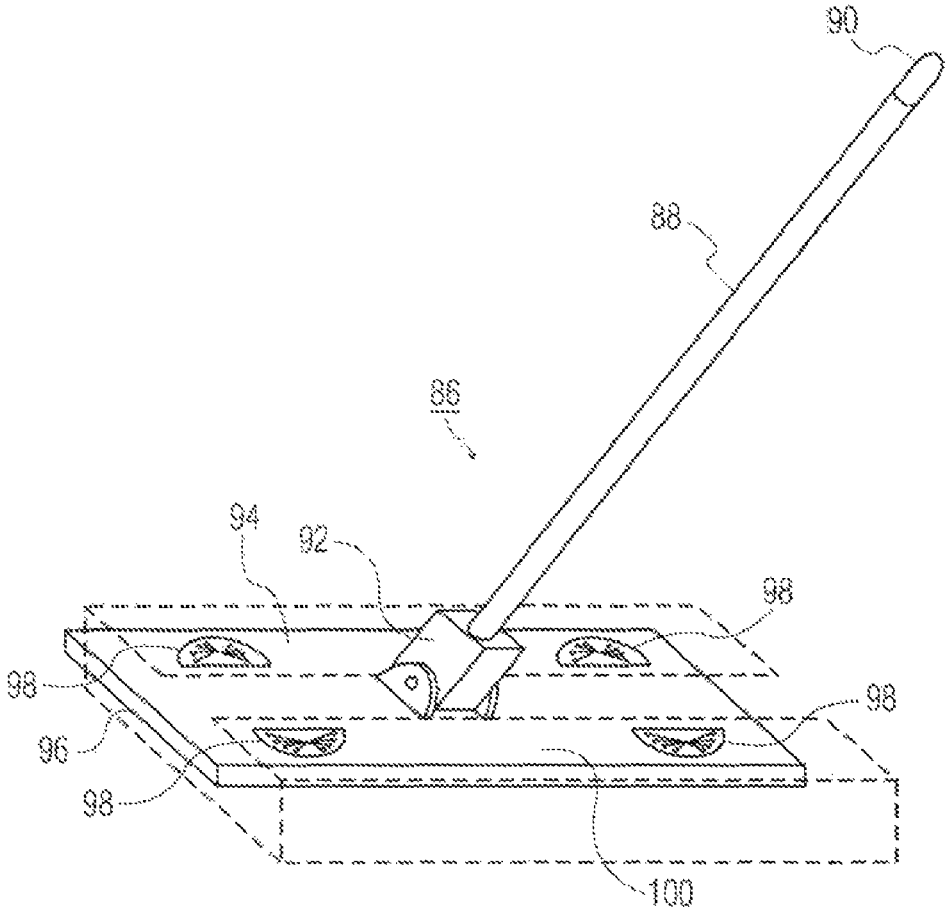
FIG. 9 PRIOR ART
FIG. 9 is an isometric view of a prior art mop with the platen of FIG. 8 attached showing a cleaning cloth member in phantom as used with this platen.

In FIG. 9, an alternative mop 86 of the prior art is shown. This mop has a shaft 88 and a handle 90 at one shaft end. The other shaft end is attached to a universal swivel joint 92. A rigid support platen 94 is attached to the shaft 88 by joint 92. The platen 94 has a planar bottom surface 96. The top surface 100 of the platen 94 has an array of four sheet material attachment devices 98 each at one of the four corners of the platen top surface 100. Each device 98 comprises a stiff, but flexible membrane 102, FIG. 8, overlying a cavity (not shown) in the platen 94. The membrane 102 has an array of slits 104 forming flexible closely spaced fingers terminating at a common central vertex.

The membrane 102 is used to secure a flexible sheet material such as a cleaning cloth by insertion of an edge of the cloth between the flexible fingers. The cloth can then be easily removed by pulling it from the fingers which frictionally hold the cloth temporarily in place. Such a platen is disclosed for example in U.S. Pat. No. 6,871,372 incorporated by reference herein and in commercially available mops as discussed in the introductory portion.

Figure 7:
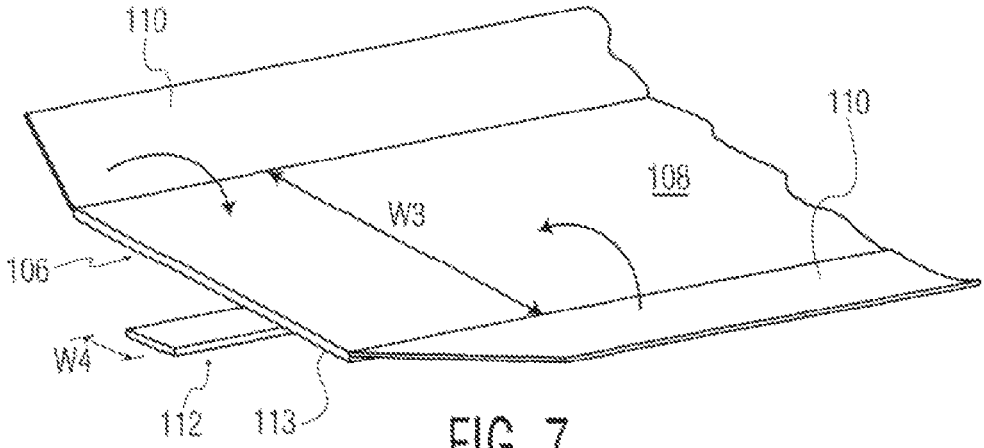
FIG. 7 is an isometric exploded view of a further embodiment of a cleaning pad and abrasive scrubbing device for use with a mop support platen depicted in the embodiment of FIGS. 8 and 9.

In FIG. 7, a rectangular cleaning cloth pad 106 is commercially available wetted or dry. The wet cloth pad is packaged in a stack soaking wet in a moisture impervious package and available under the Swiffer® brand. The cloth pad is soaked in a liquid cleaning solution. The pad 106 has a central rectangular pad section 108 which is relatively thick to provide a cleaning element for a surface such as a floor. Attached to the pad section 108 at opposite edges are two respective rectangular flaps 110 which can rotate in the direction of the arrows. The flaps 110 are thinner than the central section 108. The central section 108 is juxtaposed with the bottom surface 96 of the platen 94. FIGS. 8 and 9. The flaps are then wrapped over the top surface as shown in the aforementioned '372 patent and in phantom in FIG. 9. The corners of the flaps are then attached to the attachment devices 98 as described.

In FIG. 7, an abrasive scrub device 112 is attached to the bottom surface 113 of the section 108 somewhat in the middle or any other region as desired. The scrub device 112, of any desired predetermined abrasive value as available commercially as discussed in the introductory portion, is attached using any of the arrangements described above in connection with device 44 and so on. The Velcro® brand devices are convenient as they are available with adhesive layers readily available for attachment and because they allow releasable attachment of the scrubbing device. Because the pad section 108 is wet with cleaning liquid, the Velcro® fastener may be attached to the section 108 prior to wetting and the device 44 attached by a mating Velcro® fastener.

In the alternative, any suitable releasable or permanent adhesive may be used to attach the abrasive scrub device 112 and which may be permanently factory attached according to a given implementation. The device 112 may comprise any or all of the abrasive materials of the type described above. The device 112 may also have any desirable relative width w4 as compared to the width w3 of the central section 108 and may be releasably attached so as to make the full surface of section 108 available for cleaning as desired. In the alternative, the device 112 may be of narrower width than that of the section 108 in the range of about 5% to about 75% of the width w3 of the section 108.

Figure 5:
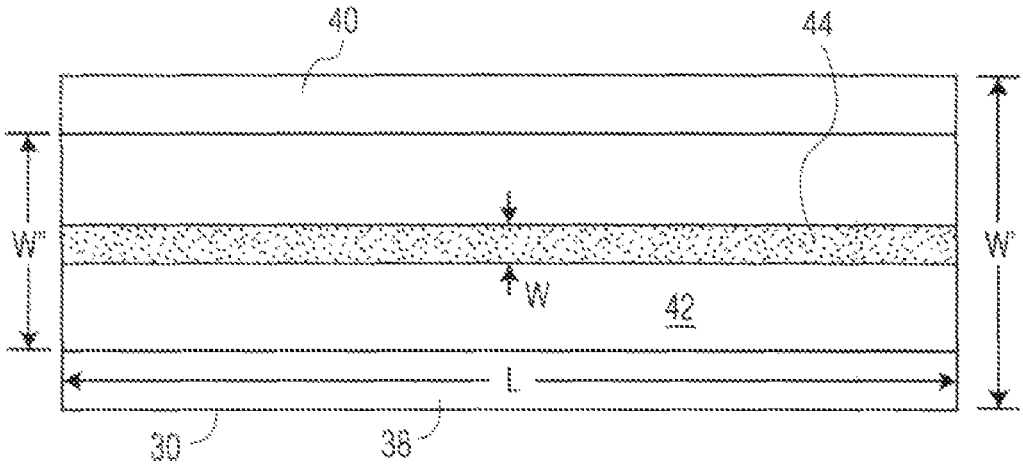
Figure 5A:
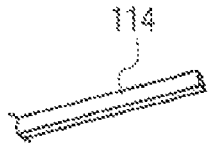

In FIG. 5*a*, a segment of a strip 114 of sheet metal or plastic or other material is part of a large length and is coiled with memory to provide a randomly coiled mass such as presently available cleaning pads discussed above. The edges of the strip 114 form an abrasive surface in the mass. This mass then forms the abrasive scrub portion of the various abrasive devices discussed above.

In the alternative, any known or developed abrasive material may be used for the abrasive scrub device. While the abrasive device may be used on conventional household floors it may be used on other surfaces as well. For example, it may be used on ceramic tile, concrete, slate, flag stones, stucco, or any other material. The abrasive material may also be in the form of a wire brush as commonly used to clean barbecue grills or sand paper or other polishing and abrading substrates according to a given implementation. In some applications, it may not be necessary to remove the abrasive scrub device where rough surfaces such as stucco are employed. In this case, the sprayed cleaning fluid may be of the type suitable for such materials in combination with the abrasive scrub device performing all of the cleaning on such rough surfaces. Thus the swivel platen head on the disclose mop may have widespread applications for use other than typical household floor cleaning purposes, e.g., tiled walls, and so on.

Figure 11:
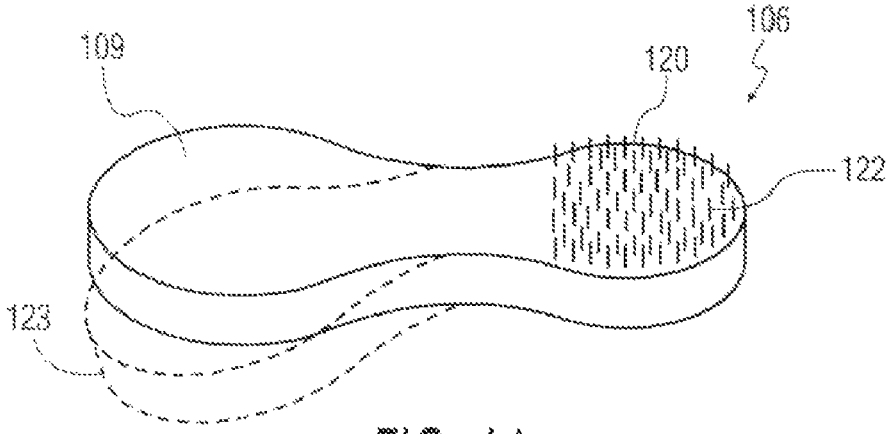
FIG. 11 is an isometric view of a universal handle for a scrub device according to a further embodiment of the present invention.
Figure 12:
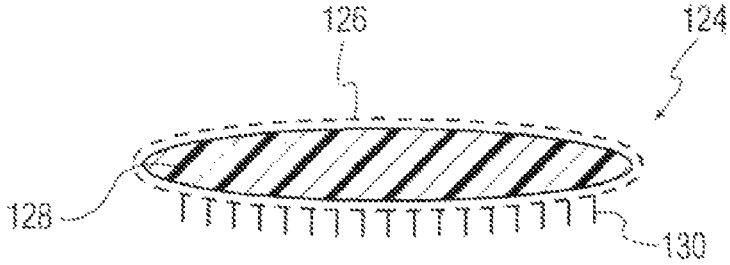
FIG. 12 is a side elevation sectional view of a scrubbing pad for use with the handle of FIG. 11.

In further alternatives, the abrasive cleaning pads may be releasably attached to each other and to a handle for floor or wall application, or a hand held handle such as a Quickie® brand hand held pot and pan scrub brush. In FIG. 11, for example, handle 106 has a hand holdable section 109 arranged to fit in the palm of the average hand. Attached immediately next adjacent to section 108 is work section 120. The two sections may be in the form of a FIG. 8 but this is by way of example and may have any desired shape. The handle 106 may be made of wood or molded thermoplastic for example. The sections may be coplanar or lie in different planes as desired as shown in phantom at 123. Section 120 forms a platen loaded with an array of Velcroϕ type hook fasteners 122 for example or other attachment devices. These fasteners are for releasably receiving various scrub pads. In FIG. 12 a scrub pad 124 of the Dobie® and O-Cello® brand types is shown. The pad 124 has a knitted outer open plastic mesh 126 and an inner plastic sponge 128. Loop type Velcro® fasteners 130 are attached to a surface of the pad 126. The fasteners 130 releasably attach to the fasteners 122. The pad 124 may be of conventional thickness such as on the commercially available pads or any other thickness. The pads 124 may be thinner than the commercial pads for attachment to the pad 30 of FIG. 5. The pad 124 thickness may be about 10-30% the thickness of the commercial pads for attachment to the pad 30 and encompasses a broad surface area that may the same as or less than that of pad 30.

In further alternatives, the abrasive cleaning pads may be releasably attached to each other and to a handle for floor or wall application, or a hand held handle such as a Quickie® brand hand held pot and pan scrub brush. In FIG. 11, for example, handle 106 has a hand holdable section 109 arranged to fit in the palm of the average hand. Attached immediately next adjacent to section 109 is work section 120. The two sections may be in the form of a FIG. 8 but this is by way of example and may have any desired shape. The handle 106 may be made of wood or molded thermoplastic, for example. The sections may be coplanar or lie in different planes as desired as shown in phantom at 123. Section 120 forms a platen loaded with an array of Velcro® type hook fasteners 122, for example, or other attachment devices. These fasteners are for releasably receiving various scrub pads. In FIG. 12, a scrub pad 124 of the Dobie® and O-Cello® brand types is shown. The pad 124 has a knitted outer open plastic mesh 126 and an inner plastic sponge 128. Loop type Velcro® fasteners 130, per the present invention, are attached to a surface of the mesh 126 of the pad 124. The fasteners 130 releasably attach to the hook fasteners 122 of the handle 106, FIG. 11. The pad 124 may be of conventional thickness such as on the commercially available pads or any other thickness. The pads 124 may be thinner than the commercial pads for attachment to the pad 30 of FIG. 5. The pad 124 thickness may be about 10-30% the thickness of the commercial pads for attachment to the pad 30 and encompasses a broad surface area that may be the same as or less than that of pad 30.

Figure 13:
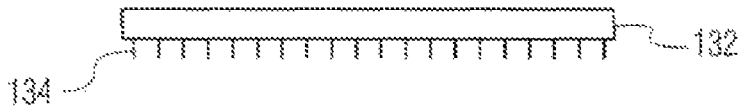
FIG. 13 is a side elevation view of a further embodiment of a scrubbing pad for use with the handle of FIG. 11.

In FIG. 13 pad 132 may be a fibrous plastic abrasive pad of the type described above and available under the Scotch Brite® brand, the O-Cello® brand, the Chore Boy® brand, the Quickie® brand abrasive pads or any other brand, for example. This pad is in the form of sheet material and has an array of Velcrow® brand loop fasteners 134 attached to one surface thereof. The fasteners 134 mate with the fasteners 122 on the handle 106 and mate with the section 120 for releasable attachment thereto.

Figure 14:
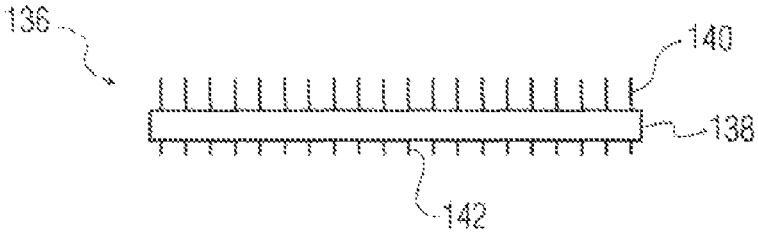
FIG. 14 is a side elevation view of a further embodiment of a scrubbing pad for use with the handle of FIG. 11

FIG. 14 shows a bristle brush attachment 136 comprising a substrate 138 to which are attached fibrous or metal bristles 140. The substrate may be woven, plastic molded sheet material or any other material suitable for receiving the bristles 140. An array of Velcro® brand loop fasteners 142 is attached to the substrate on a surface thereof opposite the bristles 140.

FIG. 5 shows an other embodiment of a pad attachment 143 for use with the handle 106, FIG. 11. Here, a plurality of pads 144, 146, 148, 150 and 152 are releasably attached to one another by releasably fasteners such as Velcrow® brand hook and loop fasteners or any other releasable arrangement such as an adhesive or the like. The loops are on one surface of a pad and the hooks are on a second surface of the mating pad. To ensure the surface of the pad is exposed for cleaning and scrubbing, the fasteners are arranged only at the edges of the pads, for example, at the opposite edges, the pad being rectangular or circular. If circular, the fasteners are at the circumference of the pad.

Figure 16:
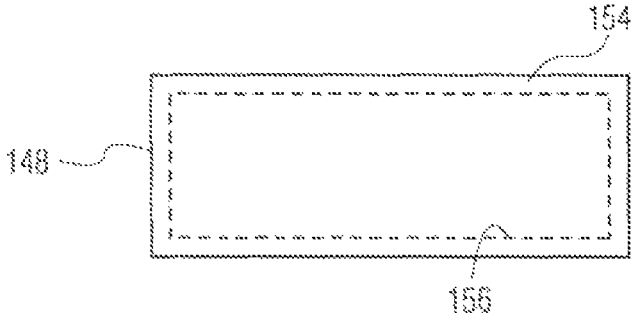
FIG. 16 is a plan view of a pad of FIG. 15.

In FIG. 16, pad 148 has fasteners 154, either hook or loop type, in the dashed line region 156 at the peripheral edge of the pad 148. The loop type fasteners are on one surface and the hook type fasteners are on the opposite surface. Thus a major portion of the pad 148 has an exposed abrasive cleaning surface. The pad 148 may be of any of the type of pads described herein. The hook and loop fasteners are formed of molded plastid fibers, and form a soft and very slight abrasive surface that is relatively harmless to most surfaces. If anything, the loops and hooks can form an additional mild abrasive surface to the pad. Also, the region 156 may be shaped to mate with the peripheral region of the section 120 of the handle 106, FIG. 11 to provide additional versatility to the attachment 143.

Each of the pads 144, 146, 148, 150 ad 152 have similar hook and loop fasteners that mate to releasably attach the pads to one another in layers as shown. The lowermost layer pad 152 has loop fasteners 158 that attach to the hook fasteners of a handle such as handle 106, FIG. 11 for example, or any other support structure for using the pads.

As the pads 144-152 are used, they are peeled off from the remainder of pads and discarded. The upper surface 160 of pad 144 is exposed for abrasive or other desired cleaning of a surface. The loop fasteners 158 are soft and pliable mold plastic fine fibers as commercially available from Velcro Corp. and relatively non-irritating to a users hand. A sponge handle may also be formed in place of pad 152 and which may be of thicker material to be readily grasped by a user. Velcro® fasteners may also be attached to such a sponge handle for attachment to a more rigid handle.

Figure 15:
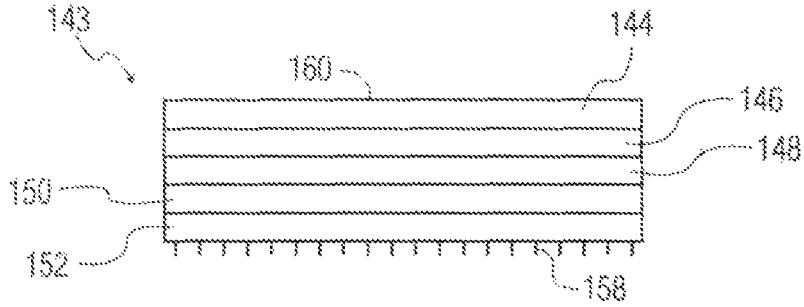
FIG. 15 is a side elevation sectional view of a further embodiment of a scrubbing pad for use with the handle of FIG. 11 or for use as a separate scrubbing pad without the handle.
Figure 17:
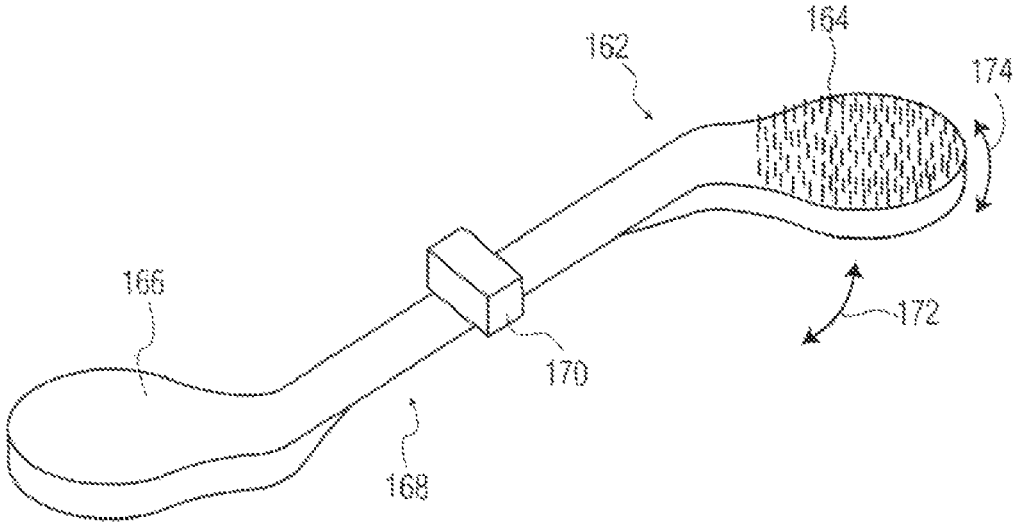
FIG. 17 is an isometric view of the a handle according to a further embodiment of the present invention.

FIG. 17 shows a rigid handle 162 having a work section 164 with Velcro® fasteners, a handle section 166 to fit in the palm of a user, and an elongated joint section 168 having a joint 170 that permits the work section to be rotated in different directions of arrows 172, 174 about different axes of rotation. The work section 164 can receive any pad or pads of the attachment 143, FIG. 15.

In this way, various abrasive pads may be releasably attached to the same handle for reuse of the handle. The different pads may also be attached to each other in layers wherein one layer at a time is peeled off as it is used. This is especially useful for sheet material type abrasive pads such as the Scotch Brite® brand pads or the Chore Boy Golden Fleece® brand or the modified Dobie® and the like brands discussed in the introductory portion and hereinabove.

It should be understood that the term pad as used in the claims refers to either sheet material or to a sheet material surrounding and encasing a filling material In most of the disclosed embodiments, the pads are generally flat or have substantially flat surfaces notwithstanding these outer surfaces may be somewhat curved as well. These outer surfaces in some of these embodiments are generally coplanar with the underlying support surface as one option. If the pads have curved outer surfaces then a plane defined by such a surface is generally coplanar with the underlying support surface in other embodiments.

It will occur to one of ordinary skill that modifications may be made to the disclosed embodiments without departing from the scope of the invention as defined in the appended claims. The disclosed embodiments are given by way of illustration and not limitation.

Figure 10:
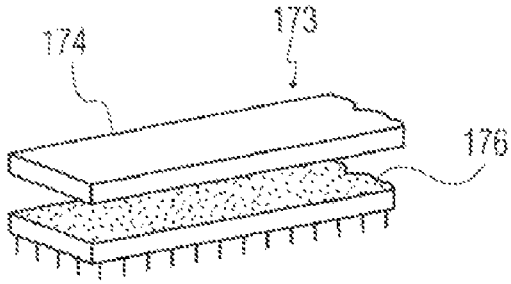
FIG. 10 is an isometric exploded view of an abrasive scrubbing device according to a further embodiment.

FIG. 10 shows a an alternative embodiment 173 comprising a handle 174 and a scrub brush 176. The handle 174 and the scrub brush 176 are of about the same area and shape. The scrub brush is attached to the handle.

What is claimed is:

1. In a mop having a handle, the combination comprising:

a platen arranged to be attached to the mop handle and defining a platen surface;

a cleaning pad having a relatively non-abrasive cleaning surface, the pad overlying and attached to the platen surface for moisture absorbance and for adhering dirt and grit thereto from a surface to be cleaned;

a foreign matter scrubbing device having a relatively rough abrasive surface compared to the relatively non-abrasive cleaning surface of said cleaning pad;

the scrubbing device being releasably attached by an attachment arrangement to a portion of the relatively non-abrasive surface of the pad such that the cleaning pad with the relatively non-abrasive cleaning region has its non-abrasive cleaning surface region arranged with the abrasive surface to be both exposed to and for simultaneously stroking against and for cleaning the surface to be cleaned.

2. The combination of claim 1 wherein the scrubbing device abrasive surface is formed by a plastic material mesh.

3. The combination of claim 1 wherein the scrubbing device comprises a mass of randomly coiled strip material.

4. The combination of claim 1 wherein the scrubbing device abrasive surface is formed by abrasive grit particles attached to a sheet substrate.

5. The combination of claim 1 wherein the scrubbing device abrasive surface is formed by an abrasive fibrous material.

6. The combination of claim 1 wherein the scrubbing device comprises a substrate to which an abrasive material is attached.

7. The combination of claim 1 wherein the cleaning pad has a length and a width, the scrubbing device comprises a strip having a length no greater than the cleaning pad length and a minimum width less than and a maximum width of about the width of the cleaning pad.

8. The combination of claim wherein the attachment arrangement comprises an adhesive for releasable attachment of the scrubbing device to the cleaning pad cleaning surface.

9. The combination of claim 1 with the attachment arrangement including an array of hook or loop elements for attaching the scrubbing device to a complementary array of interlocking hook or loop elements on the cleaning pad cleaning surface.

10. A cleaning device comprising:

an elongated handle;

a platen attached to the handle;

a moisture absorbent and dirt and grit adhering cleaning pad attached to the platen and having a first relatively non-abrasive cleaning surface for cleaning an object surface, the non-abrasive cleaning surface being located within a cleaning region of the pad; and a scrubbing element releasably secured by an attachment device to the pad cleaning surface and having a second relatively rough abrasive cleaning surface as compared to the pad first cleaning surface, the scrubbing element being located in the pad cleaning region so that both at least a portion of the pad cleaning surface and the scrubbing element are exposed to a surface to be cleaned for simultaneously cooperatively cleaning the surface to be cleaned.

11. The device of claim 10 wherein the scrubbing element is approximately coplanar with the pad non-abrasive cleaning surface.

12. The cleaning device of claim 10 wherein the scrubbing element comprises a mesh or fibrous material.

13. The cleaning device of claim 10 wherein the attachment device comprises a releasable adhesive.

14. The cleaning device of claim 10 wherein the attachment device includes an array of hook or loop elements on the scrubbing element for interlocking attachment to a complementary array of hook or loop elements on the pad.

15. A cleaning arrangement comprising:

a moisture absorbing cleaning pad having a relatively non-abrasive substantially flat cleaning surface over a cleaning region of the pad, the pad being attached to a handle for manipulating the arrangement in a cleaning mode;

a relatively abrasive cleaning material compared to the cleaning pad substantially flat cleaning surface and forming an abrasive cleaning pad having a relatively abrasive scrubbing surface as compared to the cleaning pad surface; and an attachment arrangement for releasably attaching the abrasive cleaning material to and in abutting substantially coplanar juxtaposed relationship to the moisture absorbing cleaning pad flat cleaning surface so that the moisture absorbing cleaning pad and abrasive cleaning pad simultaneously cooperate to clean a given surface.

* * * * *